US010941457B2

(12) United States Patent
Lee et al.

(10) Patent No.: US 10,941,457 B2
(45) Date of Patent: Mar. 9, 2021

(54) NON-ORIENTED ELECTRICAL STEEL SHEET AND METHOD FOR MANUFACTURING THE SAME

(71) Applicant: POSCO, Pohang-si (KR)

(72) Inventors: Se Il Lee, Pohang-si (KR); Hun Ju Lee, Pohang-si (KR)

(73) Assignee: POSCO, Pohang-si (KR)

( * ) Notice: Subject to any disclaimer, the term of this patent is extended or adjusted under 35 U.S.C. 154(b) by 303 days.

(21) Appl. No.: 15/539,610

(22) PCT Filed: Dec. 21, 2015

(86) PCT No.: PCT/KR2015/014037
§ 371 (c)(1),
(2) Date: Jun. 23, 2017

(87) PCT Pub. No.: WO2016/105056
PCT Pub. Date: Jun. 30, 2016

(65) Prior Publication Data

US 2017/0362676 A1 Dec. 21, 2017

(30) Foreign Application Priority Data

Dec. 24, 2014 (KR) ..... 10-2014-0189064

(51) Int. Cl.

| | |
|---|---|
| ***C21D 9/46*** | (2006.01) |
| ***C22C 38/02*** | (2006.01) |
| ***C21D 8/12*** | (2006.01) |
| ***C21D 6/00*** | (2006.01) |
| ***C22C 38/00*** | (2006.01) |
| ***C22C 38/04*** | (2006.01) |
| ***C22C 38/06*** | (2006.01) |
| ***C22C 38/14*** | (2006.01) |
| ***C22C 38/60*** | (2006.01) |

(52) U.S. Cl.
CPC ..... *C21D 9/46* (2013.01); *C21D 6/008* (2013.01); *C21D 8/12* (2013.01); *C21D 8/1222* (2013.01); *C21D 8/1233* (2013.01); *C21D 8/1261* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/14* (2013.01); *C22C 38/60* (2013.01)

(58) Field of Classification Search
CPC ..... C22C 38/004
See application file for complete search history.

(56) References Cited

U.S. PATENT DOCUMENTS

| | | | | |
|---|---|---|---|---|
| 5,186,763 | A | 2/1993 | Kubota et al. | |
| 9,920,393 | B2 * | 3/2018 | Zaizen | C21D 8/12 |

FOREIGN PATENT DOCUMENTS

| | | | | |
|---|---|---|---|---|
| CN | 100999050 | A | | 7/2007 |
| CN | 104136637 | A | | 11/2014 |
| CN | 104781435 | A | | 7/2015 |
| EP | 2520681 | A2 | | 11/2012 |
| IN | 201727018445 | | | 7/2017 |
| JP | S59-157259 | A | | 9/1984 |
| JP | H05-171280 | A | | 7/1993 |
| JP | H09-125148 | A | | 5/1997 |
| JP | H11-310857 | A | | 11/1999 |
| JP | 2004-218036 | A | | 8/2004 |
| JP | 2006-131963 | A | | 5/2006 |
| JP | 2010-090474 | A | | 4/2010 |
| JP | 2010-248559 | A | | 11/2010 |
| JP | 2010248559 | A | * | 11/2010 |
| JP | 2013-044010 | A | | 3/2013 |
| JP | 2013-082973 | A | | 5/2013 |
| JP | 2014-080654 | A | | 5/2014 |
| KR | 2011-0075521 | A | | 7/2011 |
| KR | 2012-0074032 | A | | 7/2012 |
| KR | 10-2014-0084896 | A | | 7/2014 |
| KR | 20140084896 | A | * | 7/2014 |
| TW | 201329244 | A | | 7/2013 |
| WO | 2013-137092 | A1 | | 9/2013 |
| WO | WO-2013137092 | A1 | * | 9/2013 |

OTHER PUBLICATIONS

English machine translation of KR 20140084896 A of Sin et al. published Jul. 7, 2014 (Year: 2014).*
Written Open and International Search Report dated Apr. 1, 2016 issued in International Patent Application No. PCT/KR2015/014037 (with partial English translation).
Extended European Search Report dated Nov. 20, 2017 issued in European Patent Application No. 15873583.7.
Indian Office Action dated Jan. 29, 2020 issued in Indian Patent Application No. 201747021991 (with English translation).

* cited by examiner

*Primary Examiner* — Jophy S. Koshy
(74) *Attorney, Agent, or Firm* — Morgan, Lewis & Bockius LLP

(57) ABSTRACT

A method for manufacturing a non-oriented electrical steel sheet according to an exemplary embodiment of the present invention includes performing hot rolling on a slab after heating the slab to manufacture a hot rolled sheet; performing hot rolled sheet annealing on the hot rolled sheet; performing cold rolling on a steel sheet on which the hot rolled sheet annealing is completed to manufacture a cold rolled sheet; and performing cold rolled sheet annealing on the cold rolled sheet in which a difference between a cold rolled sheet annealing temperature in the cold rolled sheet annealing and a hot rolled sheet annealing temperature in the hot rolled sheet annealing is 100° C. or lower.

2 Claims, 3 Drawing Sheets

NON-ORIENTED ELECTRICAL STEEL SHEET AND METHOD FOR MANUFACTURING THE SAME

CROSS REFERENCE

This patent application is the U.S. National Phase under 35 U.S.C. § 371 of International Application No. PCT/KR2015/014037, filed on Dec. 21, 2015, which claims priority to and the benefit of Korean Patent Application No. 10-2014-0189064, filed on Dec. 24, 2014, their entire contents of which are incorporated herein by reference.

BACKGROUND OF THE INVENTION

(a) Field of the Invention

The present invention relates to a non-oriented electrical steel sheet and a method for manufacturing the same.

(b) Description of the Related Art

The non-oriented electrical steel sheet is used for a material for an iron core in a rotary device such as a motor or a generator and a static device such as a small transformer and plays an important role in determining an energy efficiency of electrical equipment. Representative characteristics of such an electrical steel sheet include iron loss and a magnetic flux density. The lower the iron loss and the higher the magnetic flux density, the better the characteristics. The iron loss represents an energy which disappears due to heat generated from the material during the magnetization. Since as the iron loss is lower, the energy lost due to the heat is reduced, the iron loss is an important factor. Further, the magnetic flux density is a value indicating a degree of magnetization under an unit strength of a magnetic field. As the magnetic flux density is increased, more magnetization may be induced with the same energy so that the higher the value, the more the energy may be transmitted in the electrical steel sheet with the same volume.

Among these, since the magnetic flux density is evaluated as a magnetizing force in a unit volume, a ratio of an element in a steel sheet with the unit volume which is easily magnetized, that is, a ratio of an iron atom is very important. Generally, Si, Al, and Mn which are elements mainly utilized for the non-oriented electrical steel sheet are non-magnetized atoms, so that as an amount of alloy thereof is increased, a saturated magnetic flux density value obtained when the steel sheet is magnetized at most under the large magnetic field is lowered and $B_{50}$ which is a value of the magnetic flux density is also lowered under the unit magnetic field strength. However, in order to reduce an eddy current loss which is induced to the steel sheet, a specific resistance of the steel sheet needs to be increased. Therefore, an amount of alloy of Si, Al, and Mn which are non-magnetic alloy elements is inevitably added and thus a study for controlling a set tissue is required to overcome deterioration of the magnetic flux density.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a non-oriented electrical steel sheet and a method for manufacturing the same. An exemplary embodiment of the present invention provides a method for manufacturing a non-oriented electrical steel sheet.

Another embodiment of the present invention provides a non-oriented electrical steel sheet.

According to an aspect of the present invention, a method for manufacturing a non-oriented electrical steel sheet includes performing hot rolling on a slab after heating the slab to manufacture a hot rolled sheet; performing hot rolled sheet annealing on the hot rolled sheet; performing cold rolling on a steel sheet on which the hot rolled sheet annealing is completed to manufacture a cold rolled sheet; and performing cold rolled sheet annealing on the cold rolled sheet in which a difference between a cold rolled sheet annealing temperature in the cold rolled sheet annealing and a hot rolled sheet annealing temperature in the hot rolled sheet annealing is 100° C. or lower.

A hot rolled sheet annealing temperature in the hot rolled sheet annealing may be performed at a temperature which is 150° C. higher than a hot finish rolling temperature in the hot rolling to manufacture a hot rolled sheet.

An annealing time from the hot finish rolling temperature to the hot rolled sheet annealing temperature in the hot rolled sheet annealing may be two minutes or shorter.

The cold rolled sheet annealing time in the cold rolled sheet annealing may be five seconds or longer.

A particle diameter of a crystal grain of a steel sheet on which the hot rolled sheet annealing is completed may be 80 μm or larger.

The slab may include Al: 0.0005% to 0.02%, Sn: 0.005% to 0.15%, P: 0.001% to 0.15%, and S: 0.0008% to 0.015% in wt % and Fe and impurities as a balance amount.

The slab may further include Sb: 0.005% to 0.15% and a value of ([Sn]+[Sb]+[P]+20*[S])/[Al] is 40 or higher.

The slab may include Si: 1.5% to 4.0%, Mn: 0.02% to 3.0%, C: 0.005% or lower (does not include 0%), N: 0.005% or lower (does not include 0%), and Ti: 0.003% or lower (does not include 0%) in wt %.

According to another aspect of the present invention, a non-oriented electrical steel sheet includes Al: 0.0005% to 0.02%, Sn: 0.005% to 0.15%, P: 0.001% to 0.15% and S: 0.0008% to 0.015% with respect to an entire composition 100 wt % and Fe and impurities as a balance amount.

The non-oriented electrical steel sheet may further include Sb: 0.005% to 0.15% and a value of ([Sn]+[Sb]+[P]+20*[S])/[Al] may be 40 or higher.

In the set tissue of the non-oriented electrical steel sheet, a volume fraction of a crystal grain having an orientation (30,0,45) as an Euler orientation may be 1.5 times higher than a volume fraction of a crystal grain having an orientation (10,0,45) as an Euler orientation.

According to an exemplary embodiment of the present invention, a non-oriented electrical steel sheet having a high magnetic flux density may be provided.

DETAILED DESCRIPTION OF THE EMBODIMENTS

Figure 1:
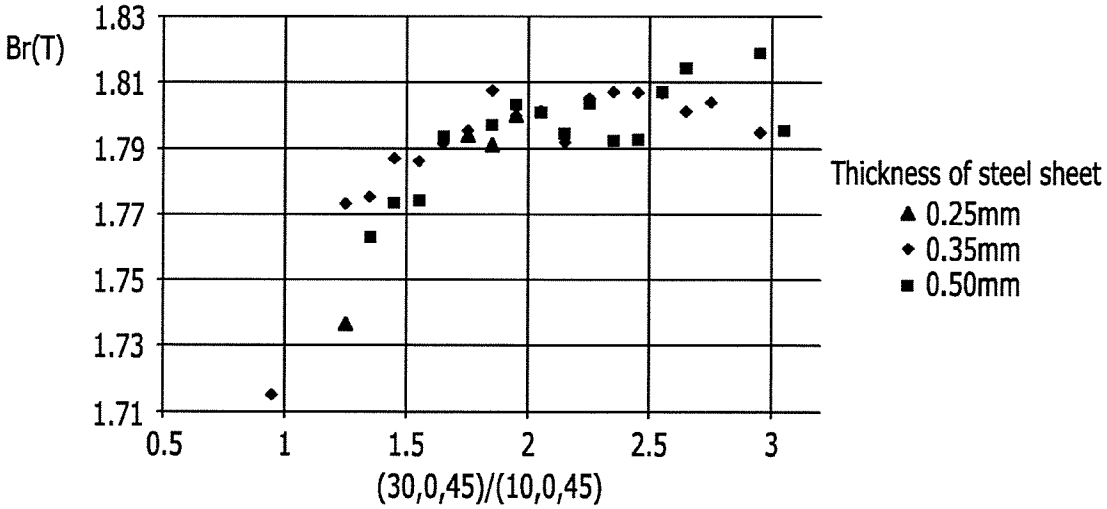
FIG. 1 is a graph illustrating a relationship of {a volume fraction of a crystal grain having an orientation (30,0,45)}/{a volume fraction of a crystal grain having an orientation (10,0,45)} and a Br value.

The advantages and characteristics of the present invention and methods for achieving the same will become clear from the embodiments set forth in detail below with reference to the attached drawings. However, the present invention is not limited to exemplary embodiment disclosed herein but will be implemented in various forms. The exemplary embodiments are provided to enable the present invention to be completely disclosed and the scope of the present invention to be easily understood by those skilled in the art. Therefore, the present invention will be defined only by the scope of the appended claims. Like reference numerals indicate like elements throughout the specification.

Accordingly, in some exemplary embodiments, well-known technologies will not be specifically described in order to avoid ambiguous interpretation of the present invention. Unless otherwise defined, all terms (including technical and scientific terms) used in the present specification may be used as the meaning which may be commonly understood by the person with ordinary skill in the art, to which the present invention belongs. In the specification, unless explicitly described to the contrary, the word "comprise" and variations such as "comprises" or "comprising", will be understood to imply the inclusion of stated elements but not the exclusion of any other elements. Unless particularly stated otherwise in the present specification, a singular form also includes a plural form.

Unless particularly mentioned, % refers to wt %.

A method for manufacturing a non-oriented electrical steel sheet according to an exemplary embodiment of the present invention will be described. First, a slab is prepared.

The slab includes Al: 0.0005% to 0.02%, Sn: 0.005% to 0.15%, P: 0.001% to 0.15% and S: 0.0008% to 0.015% with respect to an entire composition 100 wt % of the slab and Fe and impurities as a balance amount.

The slab further includes Sb: 0.005% to 0.15% and a value of ([Sn]+[Sb]+[P]+20*[S])/[Al] may be 40 or higher. Here, [Al], [Sn], [Sb], [P], and [S] refer to weight percent (%) of Al, Sn, Sb, P, and S, respectively.

The slab may further include Si: 1.5% to 4.0%, Mn: 0.02% to 3.0%, C: 0.005% or lower (does not include 0%), N: 0.005% or lower (does not include 0%), and Ti: 0.003% or lower (does not include 0%) with respect to an entire composition 100 wt % of the slab.

A reason for component restriction will be described.

When an Al added is 0.0005% or more, a specific resistance of the steel sheet is increased, which may reduce the iron loss. Further, when Al added exceeds 0.02%, the magnetic flux density may be deteriorated.

When Sn added is 0.005% or more, Sn is segregated on a grain boundary at the time of annealing to suppress formation of a {111} set tissue. However, when Sn added exceeds 0.15%, a rolling property including a surface defect may be deteriorated during hot and cold rolling processes.

When Sb added is 0.005% or more, Sb is segregated on a grain boundary at the time of annealing to suppress formation of a {111} set tissue. However, when Sb added exceeds 0.15%, a rolling property including a surface defect may be deteriorated during hot and cold rolling processes.

When P added is 0.001% or more, a specific resistance is increased to reduce the iron loss and is segregated on the grain boundary to suppress formation of a {111} set tissue which is harmful to the magnetic property and form a {100} set tissue which is useful for the magnetic property. However, when P added exceeds 0.15%, a cold rolling property may be deteriorated.

When S added is 0.0008% or more, S is segregated on a surface to lower a surface energy of a {100} plane so that a set tissue in which the {100} plane is strong may be developed. However, when S added exceeds 0.015%, workability may be deteriorated due to segregation of the grain boundary.

Further, a value of a ([Sn]+[Sb]+[P]+20*[S])/[Al] may be 40 or higher. More specifically, the value may be 40 or higher and 240 or lower. When the value of ([Sn]+[Sb]+[P]+20*[S])/[Al] is between 40 and 240, the magnetic flux density is excellent. When the value of ([Sn]+[Sb]+[P]+20*[S])/[A] is lower than 40, the magnetic flux density of the steel sheet may be deteriorated. This will be described below in Example.

1.5% or more of Si is added to lower an eddy current loss. However, when Si exceeds 4.0%, brittleness is increased so that the rolling property may be deteriorated.

0.02% or more of Mn is added to increase a specific resistance so that the iron loss may be lowered. However, when Mn exceeds 3.0%, the saturated magnetic flux density may be reduced.

When C exceeds 0.005%, an austenite area expands, a temperature range where a phase deformation is caused is increased, and growth of ferrite crystal grain is suppressed at the final annealing, so that the iron loss may be increased.

When N exceeds 0.005%, nitride is formed to suppress growth of the crystal grain so that a magnetic property may be deteriorated.

When Ti exceeds 0.003%, minute carbide and nitride are formed to suppress growth of the crystal grain and the set tissue may be deteriorated.

Further, the slab may have a component system in which an austenite phase transformation is not generated when the slab is heated at a temperature $A_1$ or higher.

The slab is subjected to the hot rolling after being heated to manufacture a hot rolled sheet.

A slab heating temperature may be 1250° C. or lower. When the slab heating temperature exceeds 1250° C., a sludge in the slab is dissolved and then minutely educed at the time of hot rolling.

When the hot rolling is performed, the hot rolling may be performed by passing a rolling pass one or more times.

Further, a final rolling pass (hot finish rolling) may be performed at a temperature of 920° C. or lower. More specifically, the temperature may be 800° C. to 920° C. When the hot rolled sheet which has been subjected to the final rolling at a temperature of 920° C. or lower is subjected to hot rolled sheet annealing at a temperature which is 150° C. higher than the hot finish rolling temperature within two minutes, a hot rolled annealed sheet having a crystal grain size which is uniform in all areas of the center and the surface of the steel sheet may be obtained. Therefore, a set tissue in which a fraction of an orientation (30,0,45) is 1.5 times higher than a fraction of an orientation (10,0,45) is obtained so that the magnetic flux density may be improved.

Thereafter, the hot rolled sheet is subjected to hot rolled sheet annealing. The hot rolled sheet annealing temperature may be 150° C. higher than the hot finish rolling temperature. Further, the hot rolled sheet annealing temperature may be in the range of 900° C. to 1200° C. Here, the hot rolled sheet annealing temperature refers to a maximum temperature of the hot rolled sheet at the time of hot rolled sheet annealing. Further, at the time of hot rolled sheet annealing, an annealing time from the hot finish rolling temperature to the hot rolled sheet annealing temperature may be two minutes or shorter.

When the hot rolled sheet annealing is performed at a temperature which is 150° C. or higher than the hot finish rolling temperature within two minutes, a hot rolled annealed sheet having a crystal grain size which is uniform in all areas of a center and surfaces of the steel sheet may be obtained. Therefore, a set tissue in which a fraction of an orientation (30,0,45) is 1.5 times higher than a fraction of an orientation (10,0,45) is obtained so that a magnetic flux density may be improved. This will be described below in Example.

Further, a particle diameter of the crystal grain in all areas of the surface and a center in the thickness direction of the steel sheet on which the hot rolled sheet annealing is completed may be 80 μm or larger. When the particle diameter is smaller than 80 μm, the crystal grain is not sufficiently grown so that a magnetic property of the electrical steel sheet may be deteriorated.

Further, a particle diameter of the crystal grain in all areas of the surface and the center in the thickness direction of the steel sheet on which the hot rolled sheet annealing is completed may be 80 μm or larger and 700 μm or smaller. The size of the crystal grain is uniformly 80 μm or larger and 700 μm or smaller in the surface and the center in the thickness direction of the steel sheet so that the magnetic property of the electrical steel sheet may be improved.

The hot rolled annealed sheet on which the hot rolled sheet annealing is completed is subjected to cold rolling thereafter to manufacture a cold rolled sheet. A reduction ratio at the time of cold rolling may be 50% to 95%.

Thereafter, the cold rolled sheet is subjected to the cold rolled sheet annealing. The cold rolled sheet annealing temperature may be 100° C. lower than the hot rolled sheet annealing temperature. Further, the cold rolled sheet annealing time may be five seconds or longer.

When a difference between the cold rolled sheet annealing temperature and the hot rolled sheet annealing temperature exceeds 100° C., even though the cold rolled sheet annealing time is maintained for five seconds or longer, a set tissue in which a fraction of an orientation (30,0,45) is 1.5 times or higher than a fraction of an orientation (10,0,45) may be obtained. This will be described below in Example.

Hereinafter, a non-oriented electrical steel sheet according to an exemplary embodiment of the present invention will be described. The non-oriented electrical steel sheet according to an exemplary embodiment of the present invention may include Al: 0.0005% to 0.02%, Sn: 0.005% to 0.15%, P: 0.001% to 0.15%, and S: 0.0008% to 0.015% with reference to an entire composition 100 wt % of the electric steel sheet.

The non-oriented electrical steel sheet further includes Sb: 0.005% to 0.15% and a value of ([Sn]+[Sb]+[P]+20*[S])/[Al] may be 40 or higher. Here, [Al], [Sn], [Sb], [P], and [S] refer to weight percent (%) of Al, Sn, Sb, P, and S, respectively. A reason for component restriction in the non-oriented electrical steel sheet has been described in the reason for component restriction in the slab, so that further detailed description will be omitted.

In the set tissue of the non-oriented electrical steel sheet, a volume fraction of a crystal grain having an orientation (30,0,45) as an Euler orientation is 1.5 times higher than a volume fraction of a crystal grain having an orientation (10,0,45) as an Euler orientation. When it is satisfied that the volume fraction of the crystal grain having an orientation (30,0,45) is 1.5 times higher than the volume fraction of the crystal grain having an orientation (10,0,45), the magnetic flux density may be improved.

FIG. 1 is a graph illustrating a relationship of {a volume fraction of a crystal grain having an orientation (30,0,45)}/{a volume fraction of a crystal grain having an orientation (10,0,45)} and a Br value.

In order to evaluate a magnetic flux density in consideration of a density of the steel sheet, a magnetic flux density of the steel sheet is evaluated in accordance with a value (Br) of the magnetic flux density considering the density of the steel sheet as it will be described below.

$$B_r=7.87/(7.87-0.065*[Si]-0.11051[Al])*B_{50}$$

Here, [Si] refers to an added amount (wt %) of Si and [Al] is an added amount (wt %) of Al.

$B_{50}$ is a value of magnetic flux density induced to the steel sheet when it is exposed to 5,000 A/m.

A reason why a density is considered rather than a normal magnetic flux density is that when it is considered that as an added amount of Si and Al in the steel is increased, an iron atom fraction in the steel is reduced and thus a saturated magnetic flux is reduced, it is possible to evaluate improvement of the magnetic flux density by the set tissue.

Referring to FIG. 1, it is understood that when a volume fraction of a crystal gran having an orientation (30,0,45) as an Euler orientation is 1.5 times higher than a volume fraction of a crystal grain having an orientation (10,0,45) as an Euler orientation, a magnetic flux density of the steel sheet considering a density is excellent.

Hereinafter, this will be described below with reference to Examples. However, the following Examples are set forth to illustrate but are not to be construed to limit the present invention.

Example 1

A slab included Si: 3.0%, Mn: 0.4%, C: 0.002%, N: 0.003%, and Ti: 0.001% in wt % and Sn, Sb, P, S, and Al had ranges such as Al: 0.0005% to 0.02%, Sn: 0.005% to 0.15%, Sb: 0.005% to 0.15%, P: 0.001% to 0.15%, and S: 0.0008% to 0.015%. Further, contents of Sn, Sb, P, S, and Al were adjusted to manufacture a slab having a value of ([Sn]+[Sb]+[P]+20*[S])/[Al] as illustrated on an X axis of FIG. 2.

The slab was subjected to hot rolling after being heated at 1150° C. to manufacture a hot rolled sheet. Hot finish rolling at the time of hot rolling was performed at 900° C. Thereafter, hot rolled sheet annealing was performed at 1100° C. and cold rolling was performed to perform cold rolled sheet annealing at 1050° C. for five seconds. An annealing time from the hot finish rolling temperature to the hot rolled sheet annealing temperature was two minutes.

Figure 2:
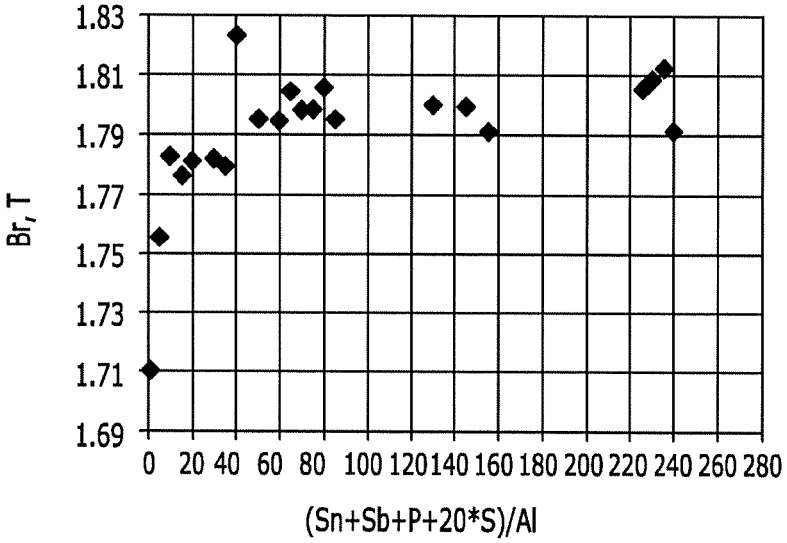
FIG. 2 is a view illustrating a relationship of a value of ([Sn]+[Sb]+[P]+20*[S])/[Al] and a Br value.

Referring to FIG. 2, it is understood that when a value of ([Sn]+[Sb]+[P]+20*[S])/[Al] is 40 or higher, the magnetic flux density is excellent.

Example 2

A slab which included Si: 3.0%, Mn: 0.4%, C: 0.002%, N: 0.003%, Ti: 0.001%, Al: 0.004%, Sn: 0.03%, Sb: 0.03%, P: 0.05%, and S: 0.005% in wt % and Fe and impurities as a balance amount was manufactured. The slab was heated at 1150° C. and then was subjected to hot rolling to manufacture a hot rolled sheet. Hot finish rolling at the time of hot rolling was performed at 900° C. Next, hot rolled sheet annealing was performed at 1100° C. and cold rolling was performed to manufacture a cold rolled sheet. An annealing time from a hot finish rolling temperature to a hot rolled sheet annealing temperature was two minutes. The cold rolled sheet was subjected to cold rolled sheet annealing at a temperature illustrated in FIG. 3 for five seconds.

Figure 3:
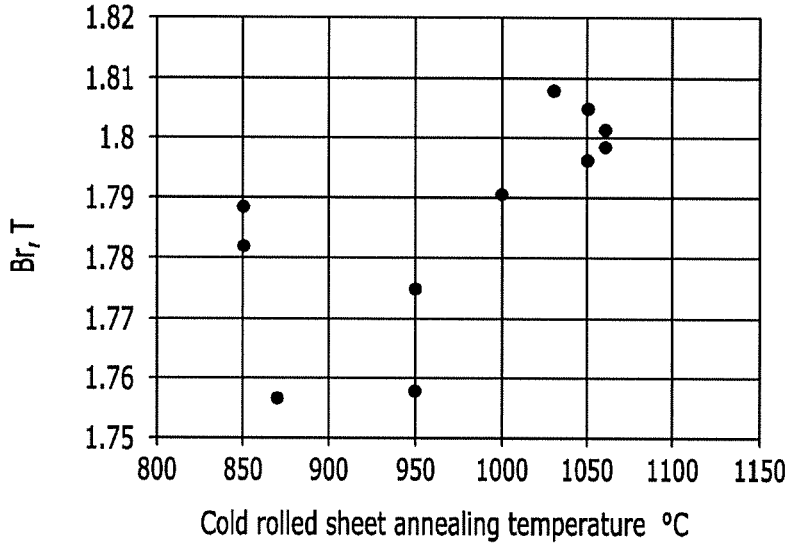
FIG. 3 is a graph illustrating a relationship of a cold rolled sheet annealing temperature and a Br value.

Referring to FIG. 3, it is understood that when a difference between the cold rolled sheet annealing temperature and the hot rolled sheet annealing temperature is 100° C. or lower, the magnetic flux density is excellent.

The exemplary embodiments of the present disclosure have been described with reference to the accompanying drawings, but those skilled in the art will understand that the present disclosure may be implemented in another specific form without changing the technical spirit or an essential feature thereof Thus, it is to be appreciated that the embodiments described above are intended to be illustrative in every sense, and not restrictive. The scope of the present invention is represented by the claims to be described below rather than the detailed description, and it is to be interpreted that the meaning and scope of the claims and all the changes or modified forms derived from the equivalents thereof come within the scope of the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A non-oriented electrical steel sheet, consisting of in wt %:

Si: 1.5% to 4.0%, Mn: 0.02% to 3.0%, C: 0.005% or lower, not including 0%, N: 0.005% or lower, not including 0%, and Ti: 0.003% or lower, not including 0%, Al: 0.0005% to 0.02%, Sn: 0.005% to 0.15%, P: 0.001% to 0.15%, S: 0.0008% to 0.015% and Sb: 0.005% to 0.15% and Fe and impurities as a balance amount, wherein a value of ([Sn]+[Sb]+[P]+20*[S])/[Al] is 40 or higher and wherein [Al], [Sn], [Sb], [P], and [S] refer to weight percent (%) of Al, Sn, Sb, P, and S, respectively, and wherein in the texture of the non-oriented electrical steel sheet, a volume fraction of a crystal grain having an orientation (30,0,45) as an Euler orientation is 1.5 times higher than a volume fraction of a crystal grain having an orientation (10,0,45) as an Euler orientation.

2. The non-oriented electrical steel sheet of claim 1, wherein a $B_r$ value of the electrical steel sheet is 1.79 T or higher, wherein $B_r=7.87/(7.87-0.065*[Si]-0.1105*[Al])*B_{50}$, [Si] is an added amount wt % of Si and [Al] is an added amount wt % of Al, and $B_{50}$ is a value of magnetic flux density induced to the steel sheet when it is exposed to 5,000 A/m.

* * * * *